US005474443A

United States Patent [19]

Viessmann et al.

[11] Patent Number: 5,474,443

[45] Date of Patent: Dec. 12, 1995

[54] RADIANT BURNER FOR BOILERS

[75] Inventors: Hans Viessmann, Battenberg; Peter Hofbauer, Rösrath-Hoffnungsthal, both of Germany

[73] Assignee: Viessmann Werke Gmbh & Co, Allendorf/Eder, Germany

[21] Appl. No.: 193,093

[22] PCT Filed: Jun. 11, 1993

[86] PCT No.: PCT/DE93/00506

§ 371 Date: Feb. 7, 1994

§ 102(e) Date: Feb. 7, 1994

[87] PCT Pub. No.: WO93/25846

PCT Pub. Date: Dec. 23, 1993

[30] Foreign Application Priority Data

Jun. 13, 1992 [DE] Germany ..... 42 19 443.1
Mar. 23, 1993 [DE] Germany ..... 9304247 U

[51] Int. Cl.[6] ..... F23D 14/14

[52] U.S. Cl. ..... 431/329; 431/328; 431/354; 126/92 A

[58] Field of Search ..... 431/326, 328, 431/354; 126/92 A

[56] References Cited

U.S. PATENT DOCUMENTS 3,291,187 12/1966 Haeusel .
3,360,028 12/1967 Saponara et al. .
3,684,260 8/1972 Solbrig .

FOREIGN PATENT DOCUMENTS 1361509 4/1964 France .
60-004718 1/1985 Japan .
60-114615 6/1985 Japan .

*Primary Examiner*—Larry Jones
*Attorney, Agent, or Firm*—Collard & Roe

[57] ABSTRACT

The invention relates to a radiant burner for boilers, consisting of a sheet metal support (1), with a gas feed line (3) leading to a gas inlet port (2) in the sheet metal support (1) and a curved burner surface (4) of wire cloth arranged at an opposite side of the sheet metal support. According to the invention, the burner surface (4) is of hemispherical shape and at least one similarly hemispherical gas distributor (5) of perforated sheet metal is arranged concentrically under the burner surface and is spaced therefrom at a distance (A) which is considerably smaller than the diameter (D) of the hemisphere of the burner surface (4) and is also affixed to the sheet metal support (1). The diameter ($D_1$) of the gas inlet port (6) corresponds substantially to the diameter ($D_2$) of the hemispherical gas distributor (5). Such a construction fulfills the requirements of a large gas inlet port, stability of the burner surface and good gas distribution over the burner surface.

9 Claims, 3 Drawing Sheets

Fig.1
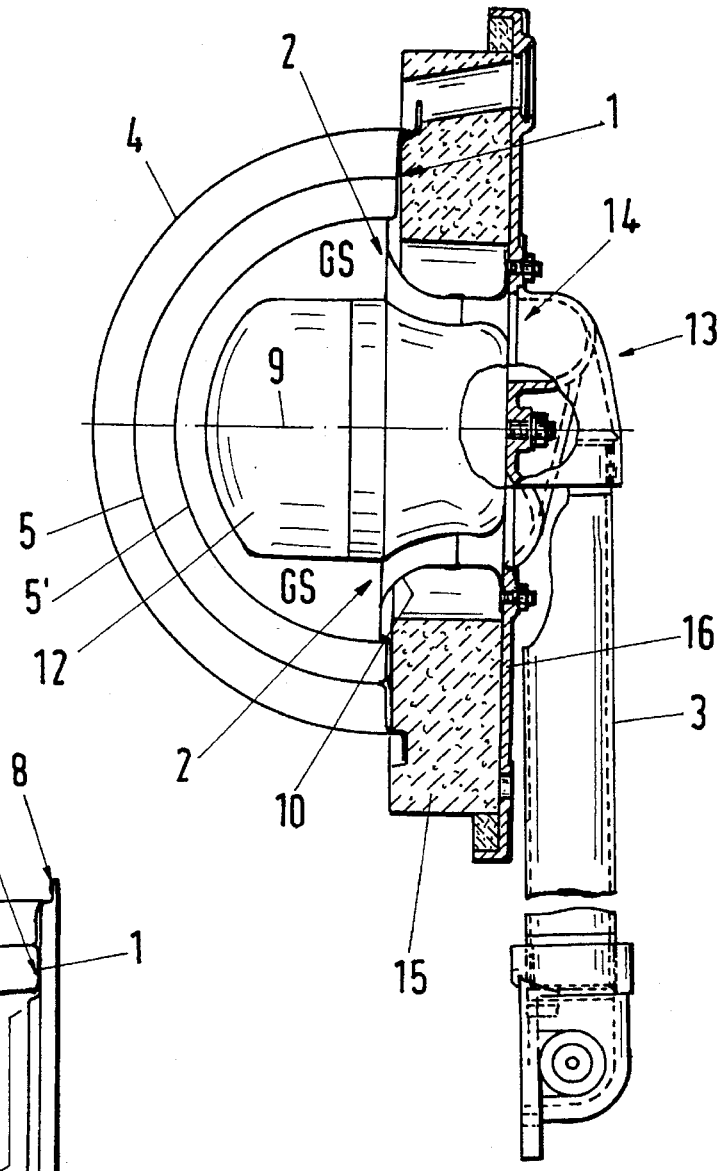
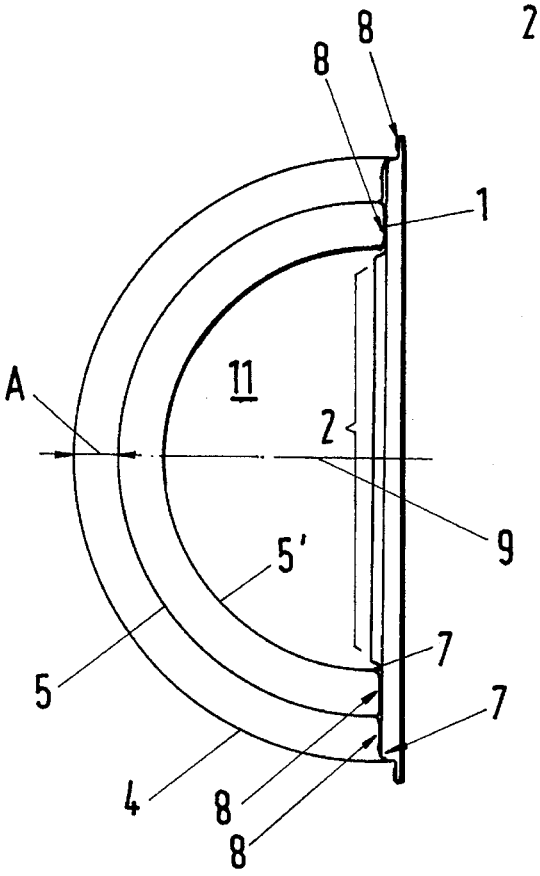
Fig.2

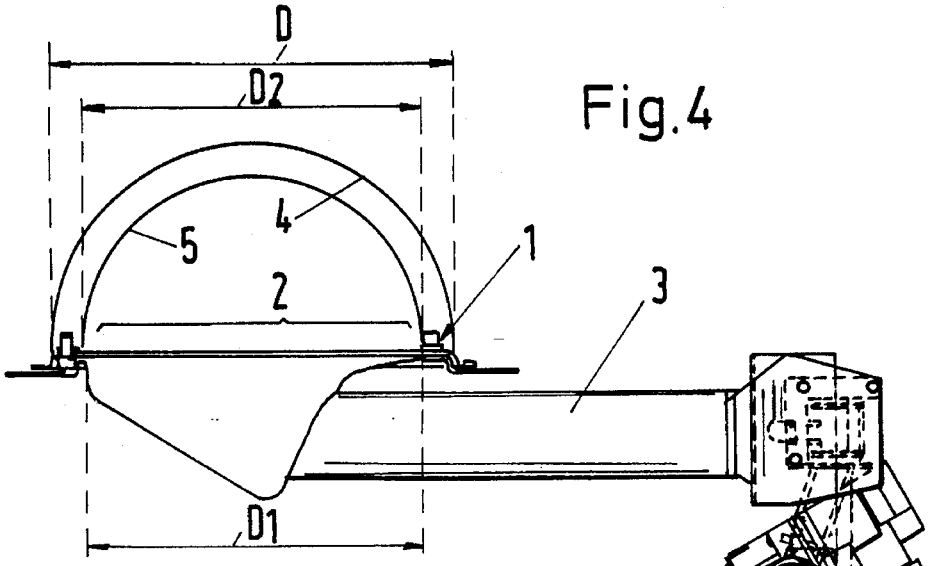
Fig.4
Fig5
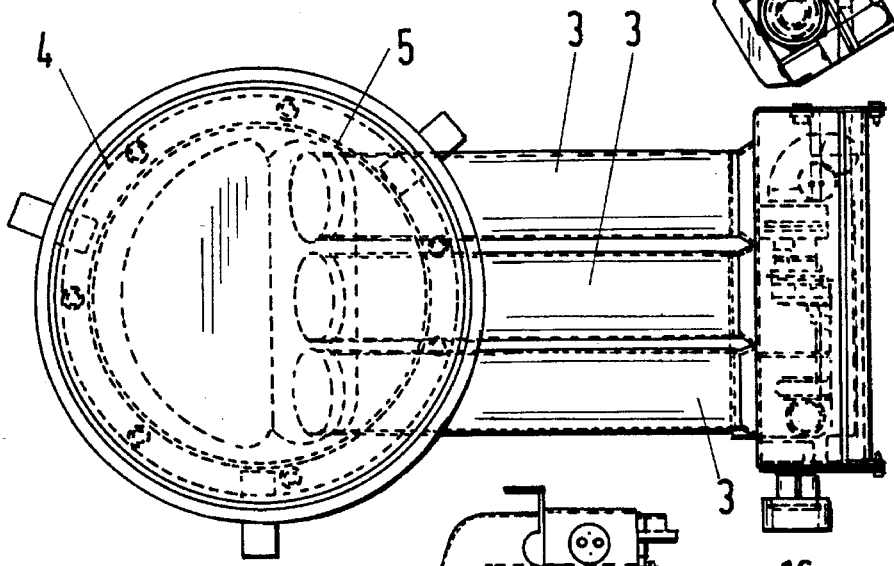
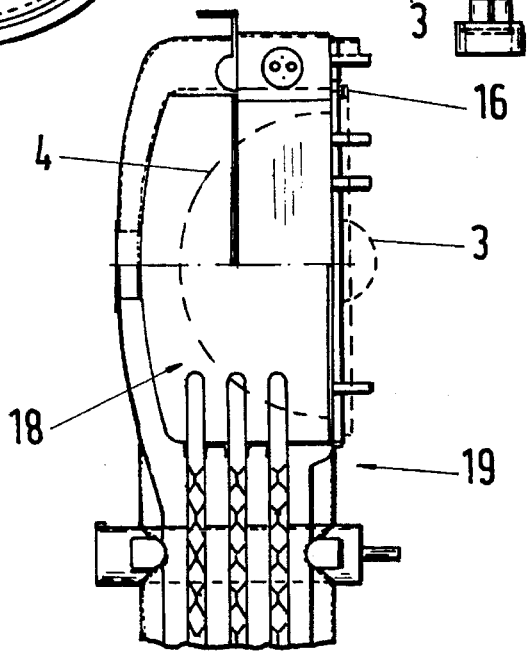
Fig.6

RADIANT BURNER FOR BOILERS

BACKGROUND OF THE INVENTION

1. Field of the Invention

The invention relates to a radiant burner for a boiler, consisting of a sheet metal support, with a gas feed line leading to a gas inlet port in the sheet metal support and a curved burner surface of wire cloth arranged at an opposite side of the sheet metal support.

2. Description of the Prior Art

Such radiant burners are known, for example, from U.S. Pat. No. 3,360,028. In that case, the curved burner surface of wire cloth has an elongated, semi-cylindrical shape, which causes the circular gas inlet port to be necessarily very small relative to the burner surface and thereby results in a poor gas distribution, which is not substantially changed by a small slotted diaphragm behind the gas inlet port. Furthermore, such a burner is ill suited for modern compact shapes of combustion chambers or boilers, that is, several such semi-cylindrical burners would have to be arranged parallel and adjacent to each other to come even close to obtaining a substantially uniform radiation of the combustion chamber walls in question. The same more or less applies to the burner according to U.S. Pat. No. 3,291,187.

A similarly poor gas distribution is obtained with a radiant burner according to French patent publication No. 1,361,509, which is substantially spherical and also has a small gas inlet port relative to the size of the burner surface. In addition, the spherical shape causes considerable reflection effects towards the connecting side of the burner.

SUMMARY OF THE INVENTION

Starting with a radiant burner of the indicated type, the object of the invention is to improve such a burner so that it may have a gas inlet port which is as large as possible relative to the size of the burner surface, the burner surface may have as stable a shape as possible, and the gas distribution over the entire burner surface between gas feed port and burner surface may be as uniform as possible.

This object is obtained in a radiant burner of the indicated type with a burner surface of hemispherical shape and at least one similarly hemispherical gas distributor of perforated sheet metal arranged concentrically under the burner surface and spaced therefrom at a distance which is considerably smaller than the diameter of the hemisphere of the burner surface and also affixed to the sheet metal support, the diameter of the gas inlet port corresponding substantially to the diameter of the hemispherical gas distributor.

All requirements with respect to compactness, stability and optimal gas distribution are fulfilled with this construction according to the invention.

BRIEF DESCRIPTION OF THE DRAWING

The embodiments of the present invention and its advantages will be explained in connection with the following description of working examples.

Schematically shown is in

FIG. 1 a section of a specific embodiment of a burner as an integral unit of a boiler closure;

FIG. 2 a section of the "nude" burner with two gas distributors and the metal sheet support;

FIG. 4 also a section of the burner in atmospheric operation;

FIG. 5 a top view of the burner according to FIG. 4; and

FIG. 6 in section the arrangement of the burner in the combustion chamber of a boiler.

DESCRIPTION OF THE PREFERRED EMBODIMENTS

Figure 3:
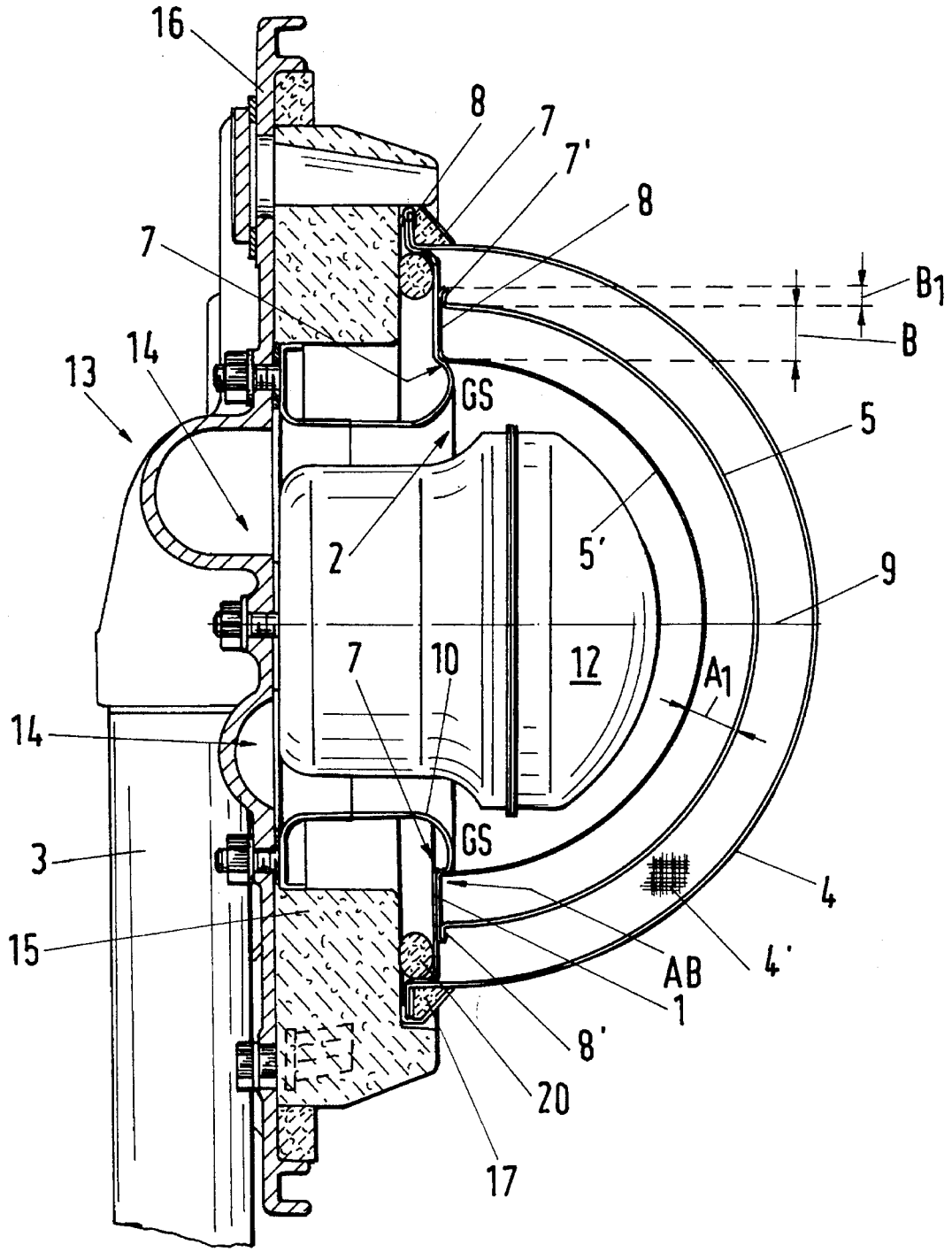
FIG. 3 a section of a special embodiment of the burner.

As conventional, the radiant burner comprises essentially sheet metal support 1, with gas feed line 3 leading to gas inlet port 2 in sheet metal support 1 and curved burner surface 4 of wire cloth arranged at an opposite side of sheet metal support 1.

However, it is essential for such a burner that burner surface 4 have a hemispherical shape and at least one similarly hemispherical gas distributor 5 of perforated sheet metal be arranged concentrically under the burner surface and spaced therefrom at a distance A which is considerably smaller than the diameter D of the hemisphere of burner surface 4 and also affixed to sheet metal support 1, diameter $D_1$ of gas inlet port 6 corresponding substantially to diameter $D_2$ of hemispherical gas distributor 5 (see FIG. 4).

Fundamentally, there is no change in this construction, that is, whether the burner is operated with a fan or atmospherically; in other words, only the manner of feeding the gas needs to be changed, as is illustrated, for example, with an atmospheric burner in FIG. 4, which has only one gas distributor 4 and which particularly clearly illustrates the size of the gas inlet port.

Sheet metal support 1 has stepped annular stampings 7 to which burner surface 4 and at least one gas distributor 5 are connected with the circumferential rim 8, which provides an advantageous attachment of hemispherical burner surface 4. Circumferential rim 8 of burner surface 4 (see FIGS. 1 and 2) is simply affixed to sheet metal support 1 by crimping the circumferential rim of the sheet metal support.

To obtain optimal gas feed in case of a fan operation, sheet metal support 1 has the shape of a gas guide funnel which is convexly curved with respect to burner axis 9 at gas feed side GS and which also has a stepped stamping 7 at the outlet, which centers the inner gas distributor 5'. In the embodiment of FIGS. 1 and 2, gas distributor 5' has a small projecting edge 7' which serves to center the second gas distributor 5 (see also FIG. 3).

Also, with burners operated with a fan, it has been found advantageous for the gas distribution to arrange a displacement body 12 in funnel 10, in interior chamber 11 of hemispherical burner surface 4 and in front of gas distributor 5', and to provide, in front of port 2 of sheet metal support 1, a gas feed chamber 13 in the form of spirally or screw-thread shaped gas guide channel 14 which is open towards interior chamber 11 and decreases in cross section, as can be seen in FIGS. 1 and 3, which also show that sheet metal support 1 is connected to carrier plate 16, with heat insulation ring 15 placed therebetween and the latter being provided with gas feed chamber 13. Carrier plate 16 forms the closure door for combustion chamber 18 of "compact boiler" 19, of which FIG. 6 shows only the upper portion which is of interest therein.

FIG. 3 illustrates a specific embodiment of the attachment of gas distributors 5, 5'. Aside from the fact that radiant burners of the hereinabove described type have had excellent success in use and boilers provided therewith show a substantially nitrogen oxide-free emission, some danger may arise where outer gas distributor 5 is attached to the sheet metal support, which extends relatively closely to the actual burner surface 4 of wire cloth and is therefore exposed to relatively high and changing temperatures, which may lead to the tearing of the attachment. While such tears do not make the burner inoperative, the uniform gas distribution to the burner surface is to a certain degree disturbed by such tears or "leaking" locations.

To counteract this, the burner of FIG. 3 is so constructed that, in the case of two gas distributors 5, 5', width B of circumferential rim 8 of inner gas distributor 5' is substantially equal to radial distance $A_1$ between gas distributors 5, 5', plus width $B_1$ of circumferential rim 8' of outer gas distributor 5, which is attached to the inner one, the inner gas distributor 5' being attached to sheet metal support 1 adjacent shoulder AB.

In this embodiment, outer gas distributor 5 is not directly connected to sheet metal support 1 but is held by the circumferential rim of inner gas distributor 5' which itself is attached to sheet metal support 1 as remotely as possible from the burner surface. This increases the tolerance for movement of the circumferential rim of the outer distributor 5, which is close to the burner surface, to a sufficient extent, and tears in the outer gas distributor 5 will no longer occur. The same effect could be obtained, by the way, if an additional carrier ring were mounted on the support, which would be affixed only to the inner circumference of the support and to which the circumferential rims of the gas distributors would be attached.

As can also be seen in FIG. 3, a further insulating ring 20 is arranged under sheet metal support 1 at the outer circumference thereof between the same and heat insulating ring 15, insulating ring 20 contacting the inside of outer stepped stamping 7 of sheet metal support 1, and finally, sheet metal support 1 is fixed with its outer circumferential rim on heat insulating ring 15 by clamping and insulating ring 17 placed on top of insulating ring 15. This construction also contributes directly to diminishing the heat at this point because it prevents gas from escaping through the lower annular rim of burner surface 4, and to burn there.

Such a ring 17 could also be placed without any difficulty on the atmospheric burner according to FIG. 4, which of course has to be arranged in horizontal position, as illustrated, in the lower portion of a boiler shaft.

We claim:

1. A radiant burner comprising (a) a sheet metal support having opposite sides and defining a gas inlet port having an axis extending perpendicularly to the sheet metal support, (1) the sheet metal support having a stepped annular rim defining two steps, (b) a gas feed line at one of the sheet metal support sides and leading to the gas inlet port, (c) a hemispherically shaped burner surface of wire cloth affixed to a side of the sheet metal support opposite the one side and arranged over the gas inlet port, (1) the burner surface having an annular rim affixed to one of the steps, and (d) a similarly hemispherically shaped gas distributor of perforated sheet metal affixed to the opposite sheet metal support side and arranged concentrically under the burner surface between the burner surface and the gas inlet port, (1) the gas distributor being spaced from the burner surface a radial distance which is substantially smaller than the diameter of the hemispherically shaped burner surface, (2) the gas inlet port and the hemispherically shaped gas distributor having substantially corresponding diameters, and (3) the gas distributor having an annular rim affixed to the other step.

2. A radiant burner comprising (a) a sheet metal support having opposite sides and defining a gas inlet port having an axis extending perpendicularly to the sheet metal support, (b) a gas feed line at one of the sheet metal support sides and leading to the gas inlet port, (1) the sheet metal support having a funnel-shaped gas guide projecting from one side thereof to the gas feed line and defining the gas inlet port, the gas guide being convexly curved with respect to the axis, (c) a hemispherically shaped burner surface of wire cloth affixed to a side of the sheet metal support opposite the one side and arranged over the gas inlet port, and (d) a similarly hemispherically shaped gas distributor of perforated sheet metal affixed to the opposite sheet metal support side and arranged concentrically under the burner surface between the burner surface and the gas inlet port, (1) the gas distributor being spaced from the burner surface a radial distance which is substantially smaller than the diameter of the hemispherically shaped burner surface and (2) the gas inlet port and the hemispherically shaped gas distributor having substantially corresponding diameters.

3. The radiant burner of claim 2, further comprising a displacement body arranged in the funnel-shaped gas guide and extending into a chamber defined by the gas distributor.

4. A radiant burner comprising (a) a sheet metal support having opposite sides and defining a gas inlet port having an axis extending perpendicularly to the sheet metal support, (b) a gas feed line at one of the sheet metal support sides and leading to the gas inlet port, (c) a spirally shaped gas guide channel arranged between the gas feed line and the gas inlet port, an outlet of the gas guide channel communicating with the inlet port and the gas guide channel decreasing in cross section, (d) a hemispherically shaped burner surface of wire cloth affixed to a side of the sheet metal support opposite the one side and arranged over the gas inlet port, and (e) a similarly hemispherically shaped gas distributor of perforated sheet metal affixed to the opposite sheet metal support side and arranged concentrically under the burner surface between the burner surface and the gas inlet port, (1) the gas distributor being spaced from the burner surface a radial distance which is substantially smaller than the diameter of the hemispherically shaped burner surface and (2) the gas inlet port and the hemispherically shaped gas distributor having substantially corresponding diameters.

5. The radiant burner of claim 4, further comprising a carrier plate for the sheet metal support, the carrier plate forming the gas guide channel, and a heat insulating ring arranged between the carrier plate and the sheet metal support around the gas guide channel.

6. The radiant burner of claim 5, wherein the sheet metal support has an annular rim, comprising a further heat insulating ring arranged between the heat insulating ring and the annular rim of the sheet metal support.

7. The radiant burner of claim 6, wherein the annular sheet metal support rim is stepped and defines an inner step and an outer step, and the further heat insulating ring is arranged between the inner rim step and the heat insulating ring.

8. The radiant burner of claim 6, further comprising a clamping and heat insulating ring affixing the annular sheet metal support rim to the heat insulating ring.

9. A radiant burner comprising (a) a sheet metal support having opposite sides and defining a gas inlet port having an axis extending perpendicularly to the sheet metal support, (1) the sheet metal support having a stepped annular rim defining two steps, (b) a gas feed line at one of the sheet metal support sides and leading to the gas inlet port, (c) a hemispherically shaped burner surface of wire cloth affixed to a side of the sheet metal support opposite the one side and arranged over the gas inlet port, (1) the burner surface having an annular rim affixed to an outer one of the steps, (d) a similarly hemispherically shaped gas distributor of perforated sheet metal affixed to the opposite sheet metal support side and arranged concentrically under the burner surface between the burner surface and the gas inlet port, (1) the gas distributor being spaced from the burner surface a radial distance which is substantially smaller than the diameter of the hemispherically shaped burner surface and (2) the gas inlet port and the hemispherically shaped gas distributor having substantially corresponding diameters, and (e) a further similarly hemispherically shaped gas distributor of perforated sheet metal affixed to the opposite sheet metal support side and arranged concentrically under the first-named gas distributor and between the first-named gas distributor and the gas inlet port, both gas distributors having annular rims affixed to an inner one of the steps of the sheet metal support, the rim of the further gas distributor having a width which is substantially equal to a radial distance between the gas distributors plus the width of the rim of the first-named gas distributor, the rim of the first-named gas distributor being attached to the rim of the further gas distributor.

* * * * *